US005392490A

United States Patent [19]

Monson

[11] Patent Number: 5,392,490

[45] Date of Patent: Feb. 28, 1995

[54] EXTRACTION CLEANER AND DRIER

[75] Inventor: Clifford L. Monson, Kirkland, Wash.

[73] Assignees: Danny C. Perry, Honolulu; Henry A. Wilks, Kailua, both of Hi.

[21] Appl. No.: 60,840

[22] Filed: May 14, 1993

Related U.S. Application Data

[63] Continuation-in-part of Ser. No. 980,206, Nov. 23, 1992, Pat. No. 5,289,610.

[51] Int. Cl.[6] ..... A47L 5/24

[52] U.S. Cl. ..... 15/320; 15/344; 15/353

[58] Field of Search ..... 15/320, 353, 321, 322, 15/344, 418, 419, 420, 421; 55/403

[56] References Cited

U.S. PATENT DOCUMENTS

| | | | |
|---|---|---|---|
| 2,355,322 | 8/1944 | Nuffer et al. | 15/344 |
| 3,072,950 | 1/1963 | Duff et al. | 15/320 |
| 3,117,337 | 1/1964 | Krammes | 15/320 |
| 3,332,101 | 7/1967 | Leinfelt et al. | 15/421 |
| 4,114,229 | 9/1978 | Jones et al. | 15/320 |
| 4,542,557 | 9/1985 | Levine | 15/344 |
| 4,559,665 | 12/1985 | Fitzwater | 15/320 |
| 4,597,124 | 7/1986 | Williams, III et al. | 15/321 |
| 4,788,738 | 12/1988 | Monson et al. | 15/320 |
| 4,930,178 | 6/1990 | Monson et al. | 15/320 |
| 5,050,266 | 9/1991 | Schneider | 15/330 |
| 5,060,339 | 10/1991 | Evers | 15/344 |
| 5,168,599 | 12/1992 | Williams | 15/320 |

*Primary Examiner*—David A. Scherbel
*Assistant Examiner*—Patrick F. Brinson
*Attorney, Agent, or Firm*—Sixbey, Friedman, Leedom & Ferguson

[57] ABSTRACT

A recycling extraction cleaner and dryer is provided which includes a unitary body member having a vacuum blower chamber, a plenum chamber and a nozzle head including a drying air discharge, a cleaning fluid discharge and a vacuum intake. A cleaning fluid container is removably mounted on the body to communicate with the cleaning fluid discharge, and a vacuum generator in the vacuum blower chamber creates a vacuum in the plenum chamber which communicates with the vacuum intake. The vacuum generator creates an exhaust air flow in the vacuum blower chamber which is directed to the drying air discharge to provide drying air under pressure to a surface to be cleaned and to increase the pressure differential between the plenum chamber and the surface contacting side of the nozzle head.

26 Claims, 3 Drawing Sheets

EXTRACTION CLEANER AND DRIER

This application is a continuation-in-part application of U.S. Ser. No. 07/980,206, filed Nov. 23, 1992, now U.S. Pat. No. 5,289,610.

TECHNICAL FIELD

The present invention relates generally to extraction cleaners and more specifically to a cleaner which is compact, light-weight, portable and which applies cleaning fluid to a soiled area of a surface and then extracts the applied fluid.

BACKGROUND ART

Cleaning machines of the type wherein a washing liquid is fed from a receptacle to a surface to be washed and, then, by means of suction, is returned to the original receptacle for further use, preferably after being filtered are known. Often these units include a tank-like receptacle that houses a pump for dispensing the cleaning liquid, a suction fan for returning the liquid, and a filtering means, while also providing the storage facility for the cleaning liquid. The tank-like receptacle is designed to sit on the floor and flexible liquid discharge and liquid return hoses connect the tank-like receptacle with a cleaning head used to apply and retrieve the cleaning liquid from the surface being cleaned. In some cases, to dispense with the pump, the liquid is provided directly from a water faucet, but then the dirty liquid is collected in the tank-like receptacle from which, in some instances, it is returned to a sink or other static drain.

While devices of the aforementioned type are portable, they are anything but compact and lightweight, particularly when their cleaning fluid tank is full. Furthermore, the presence in such apparatus of a separate tank that must rest on the floor not only makes use of the apparatus cumbersome, but is restrictive with respect to the places that such a unit can be effectively utilized. For example, long flights of steps having no landing upon which the tank can rest can render the apparatus unusable. Furthermore, because of the cumbersome nature of such units, it is often impractical to utilize the unit for spot cleaning purposes, such as cleaning up a small spill, as opposed to general room cleaning.

As a result, it is desirable to have a cleaning apparatus wherein all of the operative components are mounted upon a common element so that the unit is unencumbered by a separate floor-supported tank. In view of this, floor cleaning devices have been configured to be similar to an upright vacuum cleaner or so-called electric broom, and have all of the operative components for spraying a cleaning fluid onto a floor surface, such as a carpet, and for using suction to collect the dirty cleaning liquid, as well as a means for storing the fluid that is applied and collected mounted upon a common element. However, such devices are often not constructed to enable recycling of the cleaning fluid, and therefore the cleaning capacity of the apparatus is severely limited by the amount of fluid that can be carried. Furthermore, the versatility of such "common element" type cleaning apparatus is severely restricted to floor-type uses because these units are too large and heavy to be used in a manner that is unsupported by contact with the floor surface to be cleaned and because the units are not designed for operation in orientations that would be necessary for cleaning vertical surfaces.

To overcome these disadvantages, relatively small, light-weight, easily portable and versatile cleaning units have been developed which recycle the cleaning fluid employed so that the cleaning capacity of the unit is not limited to the surface area that can be cleaned with a single application of a limited quantity of cleaning fluid carried by the unit. Instead, the fluid which is applied to a surface and then vacuumed back into the unit is recycled and used again. My previous U.S. Pat. Nos. 4,788,738 and 4,930,178 show improved cleaners of this type.

A common feature of all prior cleaners which first apply and then vacuum cleaning fluid from a surface is that the fluid removed from the surface is limited to that which can be entrained in a vacuum stream collated by a suction or vacuum generator mounted on the device. If the surface is formed by a carpet or other fluid absorbent material, a significant amount of the fluid will be absorbed and may remain after the vacuum operation is complete. This leaves an area which remains wet, often for several hours, until normal air drying occurs. Also, in cases where a liquid spill is to be vacuumed from a hard surface, such as a hardwood floor, removal dependent solely upon a vacuum stream is often insufficient and a slippery, wet floor surface remains.

A further problem encountered with previous units is the effective separation of fluid from air when the fluid-air mixture is extracted from a surface to be cleaned. Baffles within a cleaner plenum chamber have been used to accomplish this separation, but baffles and other obstructions in the plenum chamber tend to create turbulence which causes fluid to remain entrained in an air stream.

DISCLOSURE OF THE INVENTION

It is a primary object of the present invention to provide a novel and improved extraction cleaner and drier which operates to apply cleaning fluid to a surface, withdraw the cleaning fluid by vacuum from the surface, dry the surface with heated air, and either recycle the withdrawn cleaning fluid for subsequent use or discharge it to a drain.

Another object of the present invention is to provide a novel and improved extraction cleaner and drier which directs the heated exhaust air from a vacuum motor and blower back onto a surface from which fluid has previously been removed.

A further object of the present invention is to provide a novel and improved extraction cleaner and drier provided with a removable bidirectional twin squeegee head which aids in the vacuum removal of fluid from a surface by collecting and maintaining fluid beneath the head.

A still further object of the present invention is to provide a novel and improved extraction cleaner and drier adapted to provide fluid from an external fluid source under pressure to a surface and the return dirty fluid from the surface to an external drain without requiring the use of a large, external fluid storage tank.

Yet a further object of the present invention is to provide a novel and improved extraction cleaner and drier having a vacuum blower which exhausts substantially dry, hot air onto an area to which cleaning fluid has been previously applied. Cleaning fluid and dirt are drawn back into the cleaner by the vacuum created by the vacuum blower and are removed from the return airstream to the blower by the combination of two fluid directing, angled conduits. The first conduit directs the vacuumed stream of fluid downwardly into a receiving receptacle while a second angled conduit channels return air substantially devoid of fluid back to the vacuum blower. The second conduit prevents fluid from reaching the vacuum blower when the cleaner is in a horizontal position.

BEST MODE FOR CARRYING OUT THE INVENTION

Figure 1:
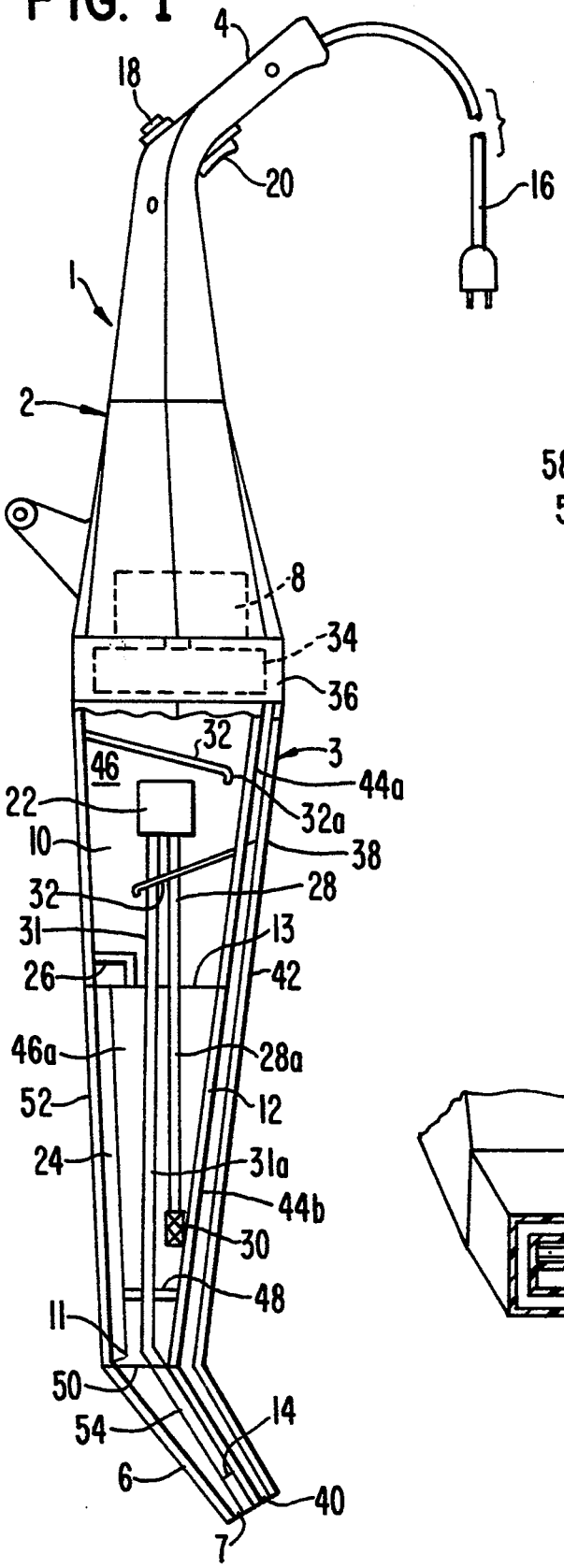
FIG. 1 is a partial cross sectional view of the recycling extraction cleaner and drier of the present invention.

With reference to the drawings, the cleaning unit 1 of the present invention is formed with a unitary body having two main body sections, namely an upper handle section 2 and a lower discharge head section 3 that are molded to form the unitary body. The upper section 2 terminates in a handle 4, while the lower section 3 terminates in a nozzle head 6 having a downward facing vacuum intake opening 7.

It should be appreciated that the cleaning unit 1 in accordance with the present invention utilizes a pump system for applying a spray of cleaning fluid to the surface to be cleaned, a vacuum extraction system to recover applied cleaning fluid and dirt entrained therewith, and a heated air system to aid in the drying of the surface to which cleaning fluid has been applied. To this end, a vacuum blower having a motor 8 (disposed at the lower end of the handle section 2) is mounted above the upper end of a hollow plenum chamber 10 formed within the lower section 3 of the extraction cleaner unit 1. The plenum chamber 10 is, itself, essentially an extension of a hollow cleaning fluid receptacle 12 which is removable from the remainder of the unit 1 by pulling it outwardly from the front of the unit. When the receptacle 12 is snapped in place within a seating space 11 between the plenum chamber and the nozzle head, gaskets or other conventional seals can be mounted on the receptacle and/or the unit, to form a leakproof seal along the juncture 13.

A spray of cleaning fluid may be selectively applied via a spray nozzle 14 when a power cord 16 is plugged into an electrical outlet and a pump switch 20 is actuated. The pump switch activates a self-priming pump 22, shown mounted to the front wall 21 of the plenum chamber above the cleaning fluid receptacle. In particular, the pump 22 draws cleaning solution from the cleaning fluid receptacle 12, through a filter 30, and up a conduit 28 to the pump, after which it is delivered, under pressure, through a spray conduit 31 to the spray nozzle 14. In this regard, while the conduit 28 may be a separate flexible tube which projects into the receptacle 12, preferably, both the conduits 28 and 31 are formed by a molded or otherwise built-in portion of the wall of the receptacle 12 so as to mate with similar conduit built-in portions **28*a* and 31*a* leading to the pump. The filter 30 prevents any solid matter that has been extracted along with the cleaning fluid into the receptacle 12 from being drawn up into the pump 22 which could lead to the pump becoming damaged or the nozzle 14 or conduits 28 and 31** becoming clogged.

In order to enable the applied cleaning fluid to be extracted by the vacuum blower via the intake opening 7 of the head 6 (upon actuation of the vacuum blower switch 18), intake opening 7 communicates with the top of receptacle 12 (that communicates with the intake side of the vacuum blower via the hollow plenum chamber 10) via the conduit 24 and deflection conduit 26. These conduits also are preferably built into the wall of lower section 3, such as by being molded portions of a plastic lower body section 3.

While the deflection conduit 26 serves to direct the returning cleaning fluid,and any solid materials extracted therewith, into receptacle 12, in order to further insure that no liquid or solid matter is drawn into the vacuum motor 8, advantageously, at least two drift eliminator blades 32 are provided. These superimposed blades 32 alternatively extend from a respective one of opposite facing walls (front and back walls as shown) and widthwise extend almost fully across the width of the plenum chamber (i.e., from one side wall to the opposite side wall). Each of the eliminator blades 32 angles downwardly and terminates at a free edge **32*a* that is formed with a 90° angle bend. As a result of the presence of these drift eliminator blades, air drawn upwardly into the vacuum blower is caused to following a meandering path and any liquids or solids entrained therewith will be brought into contact with these blades and then deflected back down from the plenum chamber 10 into the fluid receptacle 12, thereby avoiding such materials being drawn into the blower motor 8**.

The vacuum motor 8 drives an impeller 34 and both are contained in a chamber 36 and operate to lower the pressure in the plenum chamber 10. Air drawn into the chamber 36 is exhausted from the chamber under pressure down through a conduit 38 to the head 6. The chamber 36 in the embodiment of FIG. 1 can only exhaust into the conduit 38, and thus exhaust air under pressure which has been heated by the motor 8 passes out through a slot 40 in the head 6. This heated exhaust air contacts cleaning fluid applied by the spray nozzle 14 which has penetrated a carpet or other surface so as not to be completely removed by suction through the intake opening 7.

The conduit 38 is formed between an outer back wall 42 for the cleaning unit 1 and an inner back wall 44 spaced from the outer back wall. Inner back wall 44 extends across the cleaning unit between the spaced sidewalls thereof, one of which is shown at 46, to form a closed conduit which is open only at a top end into the chamber 36 and at a bottom end at the slot 40. The outer back wall 42 and an upper section **44*a* of the inner back wall are molded as part of a unitary cleaner unit body, while a lower section 44b of the inner back wall, which mates with section 44a, forms the back wall of the removable cleaning fluid receptacle 12**.

The cleaning fluid receptacle 12 has a bottom wall 48 which closes the bottom of the receptacle so that the receptacle only opens at the top along the line 13 into the plenum chamber 10. The receptacle mates with the remainder of the cleaner unit along the top edge indicated by line 13 and along the bottom edge indicated at 50. The receptacle, including the conduit sections 28a and 31a, molded into a sidewall 46a of the receptacle and the conduit 24 molded into a front wall 52 thereof may be withdrawn from the cleaner unit so that dirty cleaning fluid which has been recycled a number of times can be removed and replaced with clean cleaning fluid. Then the receptacle is replaced in the seating space 11 defined by the edges 13 and 50 causing the conduit 28a to mate with the conduit 28 while the conduit 31a mates with the conduit 31 and a nozzle conduit 54 leading to the spray nozzle 14.

Figure 2:
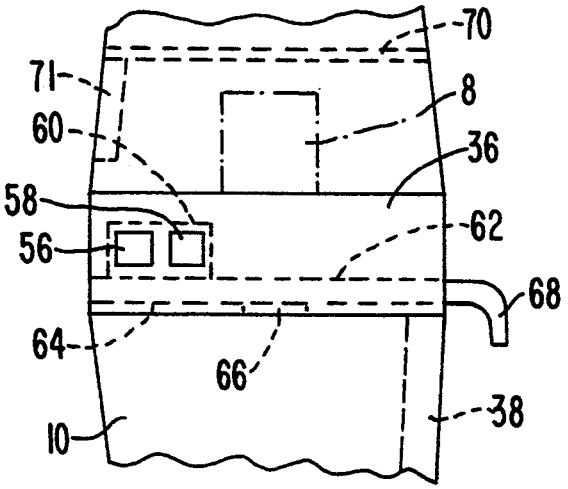
FIG. 2 is a view in side elevation of a second embodiment of the vacuum blower chamber for the recycling extraction cleaner and drier.

In some instances, it may be desirable to use the cleaning unit 1 as a dry vacuum cleaner without the application of cleaning fluid or drying air. For this purpose, as illustrated in FIG. 2, the chamber 36 may be provided with vents 56 and 58 which communicate between the chamber and the atmosphere outside the cleaner unit 1. These vents may be normally closed by a closure plate 60 mounted on a slide bar 62 which slides in a track 64 molded on the inner wall of the chamber 36. A second closure plate 66 mounted on the slide bar is adapted to close off the end of the conduit 38 when the vents 56 and 58 are opened.

To facilitate operation of the slide bar 62, the slide bar extends outwardly from the cleaner unit, and terminates in a finger tab 68. When the finger tab is drawn to the right in FIG. 2, the vents 56 and 58 are opened and the conduit 38 is closed. Now the vacuum motor 8 and impeller 34 will be vented to the atmosphere and heated, drying air will not be provided to the nozzle head. When the slide bar 62 is returned to the position shown in FIG. 2, the vents 56 and 58 are blocked and heated air is provided through the conduit 38 which now provides the only vent path from the chamber 36.

In some cases, it may be desirable to provide an internal wall 70 above the vacuum motor 8 to reduce the size of the chamber 36 and thereby provide more motor heat to the air drawn from the plenum chamber 10. If motor heat does not provide sufficient heat for the drying airstream, a small electric heater 71 can be mounted in the chamber 36.

Figure 3:
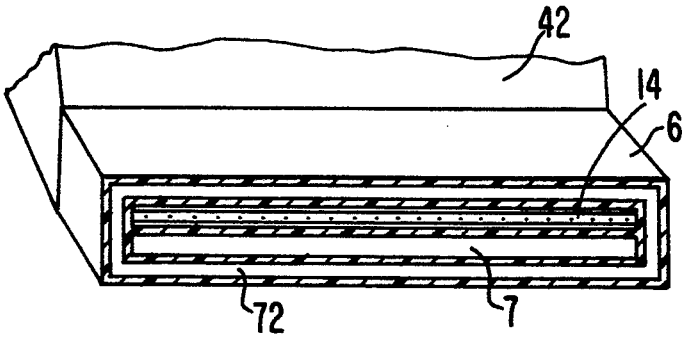
FIG. 3 is a perspective view of a second embodiment of a nozzle head for the recycling extraction heater and drier.

In FIG. 1, the nozzle head 6 is arranged with a drying air slot 40 extending across the rear of the nozzle head, a vacuum intake opening or slot 7 extending across the front of the nozzle head and the spray nozzle 14 extending therebetween across the nozzle head. However, as illustrated in FIG. 3, it may be desirable to apply drying air around the entire periphery of the nozzle head 6. For this purpose, instead of the single slot 40, the nozzle head is provided with four sided slot 72 which extends completely around the periphery of the nozzle head on all sides of the spray nozzle 14 and vacuum intake slot 7. Air passes down the conduit 38 and into the rear side of the slot 72 which extends through the nozzle head 6. The air spreads around the slot and exits on all sides of the nozzle head. Thus the spray nozzle 14 is surrounded by drying air which creates an air barrier around the spray nozzle and vacuum intake slot. This air barrier not only provides a drying function, but also concentrates the spray from the spray nozzle 14 and creates an air flow which enhances the removal of dirt and cleaning fluid by the vacuum system. The drying air under pressure increases the pressure differential between the plenum chamber 10 and the surface contacting underside of the nozzle head 6, thereby aiding in the pickup of cleaning fluid and dirt by the vacuum intake slot 7.

Figure 4:
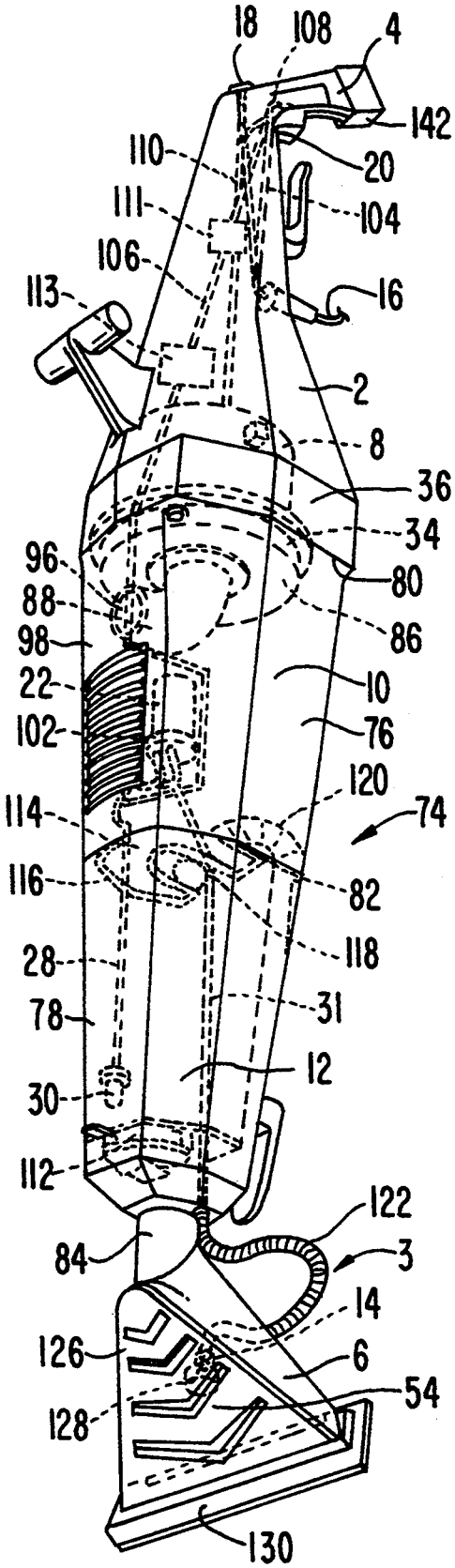
FIG. 4 is a perspective view of a second embodiment of the recycling extraction cleaner and drier of the present invention.
Figure 5:
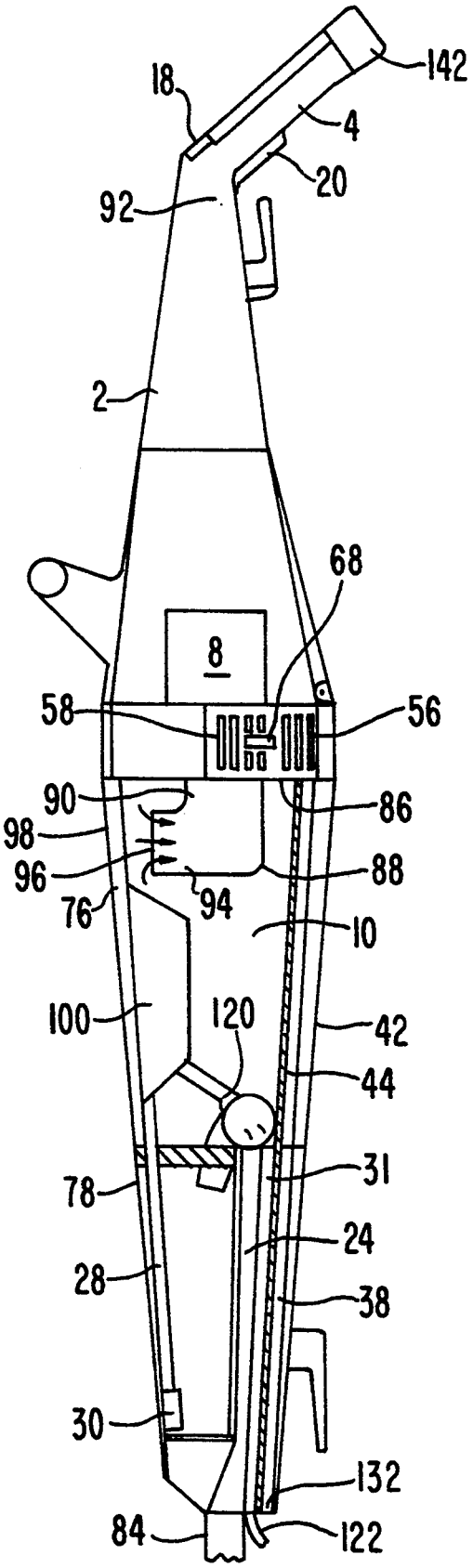
FIG. 5 is a partial cross-sectional view of the recycling extraction cleaner of FIG. 4.
Figure 6:
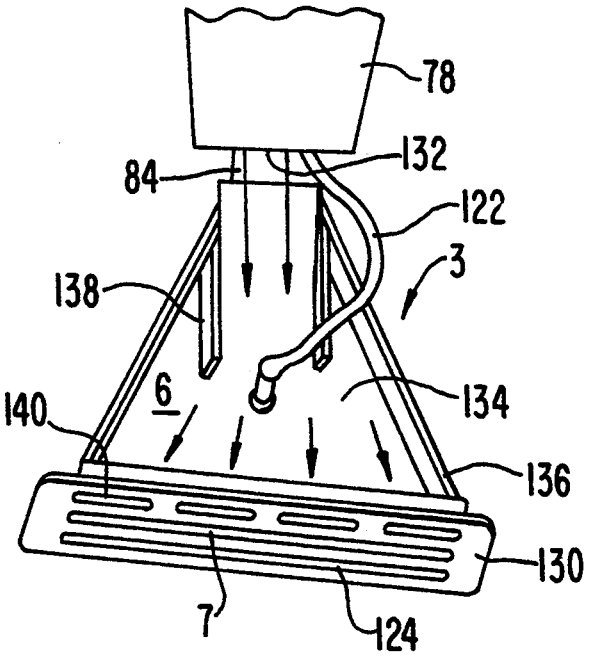
FIG. 6 is a perspective view of the nozzle head for the recycling extraction cleaner of FIG. 4.

Referring now to FIGS. 4–6, an embodiment of the recycling extraction cleaning unit of the present invention is indicated generally at 74. In these figures, components from FIGS. 1–3 which are identical in structure and have identical functions will be identified by the same reference numerals.

The recycling extraction cleaning unit 74 is formed in four sections, and includes the upper handle section 2, a central plenum chamber section 76, a fluid chamber section 78, and the discharge head section 4. The upper handle section, plenum chamber section, and fluid chamber section are bolted tightly together to prevent the escape of air and fluid from the junctures therebetween. At the juncture 80 between the handle section and the plenum chamber section, the plenum chamber section extends into the upper handle section to form a tight overlapping juncture. Similarly, at the juncture 82 between the plenum section and the fluid chamber section, the fluid chamber section fits into the plenum chamber section to provide an upper overlapping fluid tight juncture. The discharge head section 4 slides onto a conduit 84 which projects outwardly from the bottom of the fluid chamber section 78 to form an airtight seal therewith, but the discharge head section may be removed from the conduit 84.

The plenum chamber 76 is separated from the chamber 36 containing the impeller 34 by a wall 86. Communication between the plenum chamber and the chamber 36 is provided by an L-shaped conduit 88 having the first section 90 which is substantially parallel to the central longitudinal axis 92 of the extraction cleaning unit 74, and which extends through the wall 86 to provide an opening into the chamber 36. A second section 94 of the L-shaped conduit 88 extends substantially perpendicular to the central longitudinal axis 92 and opens at 96 into the plenum chamber 76. This opening is spaced closely adjacent to the front wall 98 of the plenum chamber section. Thus, the L-shaped conduit 88 provides a passage for air from the plenum chamber into the chamber 36 and permits the impeller 34 to create a vacuum or low pressure condition in the plenum chamber in the same manner as previously described relative to the plenum chamber 10.

The pump 22 is mounted in a housing 100 secured to the front wall 98 of the plenum section, and cooling air may be provided to the interior of the pump housing by louvers 102 formed in the front wall of the plenum section. The pump is powered from the power cord 16 through a power line 104 to the pump switch 20 and then from the pump switch through a power line 106 to the pump. Similarly, the vacuum blower motor is powered from the power cord 16 through a power line 108 to the vacuum blower switch 18 and then from the vacuum blower switch through a power line 110 to the vacuum blower motor. An electrical switching unit 111 is connected to the power lines 106 and 110 and will not permit power to pass through the power line 106 to energize the pump 22 until power also passes through the power line 110 to energize the vacuum blower motor. Also, a step down converter is provided at 113 to convert the 120 v AC power to 12 v DC power for the pump, so that the danger of electrical shock from the pump is eliminated. Thus, only 12 v DC power is provided to the unit in the area below the handle section 2.

As in the case of the cleaning unit 1 of FIGS. 1–3, the pump 22 draws fluid through a filter 30 and a conduit 28 to the pump. The conduit 28 positions the filter toward the bottom cleaning fluid receptacle 12 and is preferably a flexible conduit which will permit the cleaning receptacle to be removed from the front of the fluid chamber section 78. The cleaning unit receptacle is in the form of an open top transparent cup which may be locked in place and subsequently released by a suitable latching mechanism 112.

A horizontal wall 114 separates the top of the fluid chamber section 78 from the bottom of the plenum chamber section 76, and this wall bears a gasket 116 which seals the top of the cleaning fluid receptacle 12. The wall 114 includes an opening 118 which communicates with the plenum chamber 76 and therefore causes the pressure in the cleaning fluid receptacle 12 to be lowered to plenum chamber pressure.

A curved air and fluid return conduit 120 extends through the opening 118 to discharge fluid and air into the cleaning fluid receptacle 12. This curved return air and fluid conduit is angled at roughly 135° relative to the central longitudinal axis 92 so that it discharges against one of the sidewalls of the cleaning fluid receptacle 12. This minimizes fluid turbulence so that the fluid will quickly separate from the air issued from the return air and fluid conduit and run down the sidewall toward the bottom of the cleaning fluid receptacle. It has been found that if the return air and fluid conduit is a 180° conduit so that it discharges fluid and air substantially parallel to the central longitudinal axis 92, the fluid will splash at the bottom of the fluid receptacle causing turbulence which mixes the fluid with the air being drawn through the plenum chamber 76. The curved return air and fluid conduit 120 is formed at the upper terminus of the conduit 24 which conducts air and fluid from the nozzle head 6 back into the plenum chamber and cleaning fluid receptacle.

The nozzle head 6 is uniquely designed to provide both drying air and fluid to a surface to be cleaned. Fluid is provided to the nozzle head by the pump 22 under the control of the pump switch 20. Fluid pumped by the pump passes through a spray conduit 31 within the recycling extraction cleaning unit and out through a flexible tube 122 to the spray nozzle 14 which is positioned within the nozzle head 6. In this case, the spray nozzle is positioned to provide fluid under pressure to a slot 124 in the forward section of the nozzle head. The forward wall 126 of the nozzle head is preferably transparent so that the operation of the spray nozzle can be visually monitored. Preferably, the spray nozzle includes a one-way check valve 128 which is spring biased to a closed position, but which is opened under the pressure of the fluid passing through the flexible tube 122. When the fluid flow is cut off by deactivating the pump 22, the one-way check valve closes to prevent fluid which may remain in the spray conduit 31 and the tube 122 from dripping out through the nozzle conduit 55 and the fluid slot 124 onto the surface to be cleaned.

As will be noted from FIG. 4, the nozzle head 6 extends at an angle to the central longitudinal axis 92 of the recycling extraction cleaning unit 74, and angles outward beyond the outer back wall 44 of the unit. The bottom surface of the nozzle head is formed by a flat plate 130 which contacts the surface to be cleaned in most situations and which contains the fluid slot 124 that communicates with the nozzle conduit 54 within the nozzle head. The plate 130 also contains the vacuum intake opening or slot 7 which communicates with a passage through the nozzle head and conduit 84 to the conduit 24. Thus, when the vacuum blower switch 18 is activated to start the vacuum blower motor 8, the impeller 34 is driven to create a vacuum or reduction of pressure in the plenum chamber 10 and the cleaning fluid receptacle 12. Now fluid and dirt from the surface to be cleaned will be drawn through the vacuum intake opening 7 and pass through the nozzle head 6, the conduit 84, the conduit 24, and the curved return air and fluid conduit 120 into the cleaning fluid receptacle 12. It will be noted that the plenum chamber 76 is substantially unobstructed so that return air will be drawn through the opening 118 toward the top of the plenum chamber where it passes through the opening 96 and into the chamber 36. This air will be substantially free of liquid, for most of the liquid will be directed initially into the cleaning fluid receptacle. Any liquid which remains entrained in the air stream as it passes through the opening 118 will drop out as the air stream traverses upwardly across the longitudinal extent of the plenum chamber 76 and then curves inwardly through the opening 96 in the L-shaped conduit 88. The relatively open, unobstructed plenum chamber assures that there is nothing to create turbulence which would tend to maintain the fluid entrained in the air stream.

In the manner previously described, heated air under pressure is forced from the chamber 36 through the conduit 38, but in the recycling extraction cleaning unit 74, this air exits through an air opening 132 and, as indicated by the arrows in FIG. 6, contacts and spreads out across a back wall 134 for the nozzle head. The nozzle head includes sidewalls 136 which rise above the back wall 134 and which angle outwardly toward the bottom plate 130. The sidewalls in combination with raised deflection walls 138 channel the air stream through air slots 140 in the plate 130 for contact with the surface being cleaned.

It will be noted from FIG. 4 that both the nozzle head 6 and the handle 4 for the cleaning unit are at angled rearwardly of the unit so that they extend outwardly beyond the outer back wall 42. Thus, should the unit fall or be dropped, it will rest on the plate 130 and the outer end of the handle 4 which is protected by a rubber cap 142. When the unit is so oriented in a horizontal configuration, any fluid which passes through the opening 118 into the plenum chamber 76 will be prevented from reaching the impeller 34 and the blower motor 8 due to the configuration and orientation of the L-shaped conduit 88. The opening 96 for this conduit is spaced adjacent to the front wall of the extraction cleaning unit and the fluid level in the plenum chamber will rest below the L-shaped conduit when the unit rests horizontally on the handle 4 and the plate 130. Should the unit fall horizontally on either side, the fluid level from the cleaning fluid receptacle 12 will not reach the opening 96 since the conduit 88 is centrally located in the plenum chamber 76. If the unit falls forwardly, fluid will not reach the section 90 of the conduit 88. Finally, if the unit is turned upside down, the fluid level from the cleaning receptacle 12 will collect above the second section 96 of the L-shaped conduit 88 and will not reach the opening 96. Thus, the volume of the cleaning fluid receptacle 12 and the orientation and spacing of the conduit 88 relative to the walls of the plenum chamber 76 are such that fluid cannot flow through the opening 96 in any orientation of the cleaning unit 74. To provide added assurance of this, it is possible to add a spring biased closure valve to the interior of the L-shaped conduit 88 which normally closes the conduit but which opens in response to the vacuum on low pressure created by the impeller 34.

Figure 7:
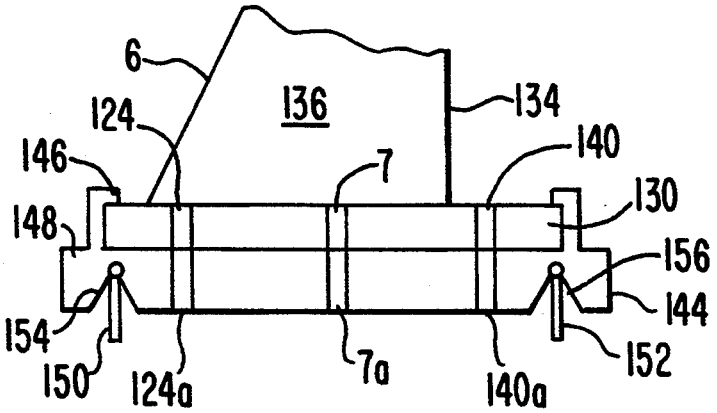
FIG. 7 is a sectional view of the nozzle head for the extraction cleaner and drier of FIG. 4 with a squeegee attachment.

Referring to FIG. 7, the recycling extraction cleaning unit 74 is adapted to receive a bi-directional twin squeegee head 144 which removably snaps onto the flat plate 130 by means of suitable attaching means 146. This squeegee head includes a base member 148 which underlies the flat plate 130 and which includes slots 124*a*, 7*a* and 140*a* to correspond with the slots 124, 7 and 140 respectively in the flat plate 130. The base member extends across the extent of the base plate 130, and at the forward and rearward ends thereof, outboard of the slots, includes a forward squeegee flap 150, and a rearward squeegee flap 152. The squeegee flaps are formed of rubber or other resilient material, and are mounted for movement within triangular channels 154 and 156 which extend laterally across the extent of the base member 148. These triangular channels permit the rubber squeegee flaps to move forward or rearwardly in response to forward or rearward movement of the nozzle head 6, and will permit the nozzle head to pick up a fluid spill when the head moves in either direction.

Figure 8:
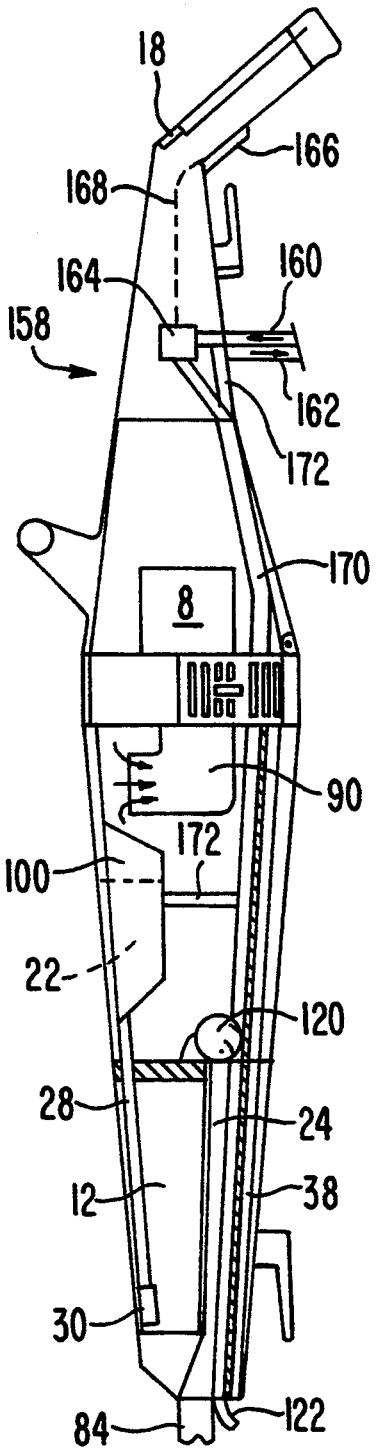
FIG. 8 is a partial cross-sectional view of a continuous flow extraction cleaner and drier.

Referring now to FIG. 8, a modification of the extraction cleaning unit 74 is provided in the form of a continuous flow extraction cleaner 158. Structural elements of this cleaner which are identical in both structure and function to those previously described relative to the recycling extraction cleaning unit 74 will be designated by like reference numerals in FIG. 8. In the continuous flow extraction cleaner unit of FIG. 8, a flexible water input line 160 and a flexible water output line 162 are provided. These lines can be relatively small, flexible lines of plastic tubing material and may be connected together along most of the extent thereof to form a single fluid conducting unit which conducts in both directions. The end of the line 160 which is remote from the extraction cleaner unit 158 is connected to a faucet or similar source of water under pressure while the remote end of the line 162 is placed in a sink or other suitable drain. Clean input water under pressure from the line 160 is fed to a valve 164 which is operated by the pump switch 166. There may be a mechanical connection 168 between the valve and the pump switch 166, or in the alternative, the valve 164 may be a solenoid or other electrically operative valve, and in this case, the pump switch 166 would operate over an electrical connection 168 to provide power to the valve. When the pump switch is actuated to activate the pump and open the valve 164, water passing through the valve is directed by a conduit 170 to the flexible tube 122 which provides fluid to the nozzle head 6. Fluid, dirt, and air are then vacuumed from the surface beneath the nozzle head in the manner previously described and pass upwardly through the conduit 84, the conduit 24, and the curved return air and fluid conduit 120 to the cleaning fluid receptacle 12. The pump 22, which has been activated in the manner described in connection with the extraction cleaning unit 74 when the pump switch 166 was operated, will now pump fluid through the filter 30 and the conduit 28 in the manner previously described, but instead of recycling this fluid, the pump forces it under pressure through a conduit 172 which extends up the rear wall of the cleaner and joins with the output fluid line 162. Thus, a continuous flow of clean water is provided to the extraction cleaner 158 and the dirty fluid removed by the cleaner is continuously pumped back to a suitable external drain. In all other respects, the continuous flow extraction cleaner 158 operates in a manner similar to that of the recycling extraction cleaning unit 74. When dirt or sludge builds up in the cleaning fluid receptacle 12, this receptacle may still be removed and flushed out, and the valve 164 is designed to provide a limited input flow volume which will not exceed the ability of the pump 22 to extract dirty fluid from the receptacle 12. This fluid receptacle is normally made of transparent material so it can be visually determined that dirty fluid is being effectively evacuated by the pump from the fluid receptacle.

Industrial Applicability

By providing a cleaning apparatus that is relatively small, lightweight, easily affordable, and versatile, and is not limited in its cleaning capacity to the surface area that can be cleaned with a single application of a quantity of cleaning with a single application of a quantity of cleaning fluid that is carriable thereby, the present invention enables such an apparatus to be produced in not only floor models, but hand held models, as well. Furthermore, the constructions in accordance with the present invention make the units produced in accordance therewith, simple and easy to use by unskilled cleaning help and the average consumer. Cleaning fluid may be applied by the apparatus to a surface to be cleaned and then recycled for reapplication to a new surface. Heated air is applied to dry fluid absorbed by the surface to be cleaned.

What is claimed is:

1. An extraction cleaner for cleaning a surface comprising:

a body member for housing internal cleaner components including a handle at a first end thereof, a nozzle head at a second end thereof opposite to and spaced from said first end, said nozzle head including a cleaning fluid discharge means and a vacuum intake means, a vacuum blower chamber formed adjacent to said handle, and a plenum chamber formed adjacent to said vacuum blower chamber, said body member including a fluid chamber seating area between said nozzle head and said plenum chamber;

a fluid receiving chamber removably mounted in said fluid chamber seating area for containing cleaning fluid, said fluid receiving chamber being mounted in communication with said plenum chamber, means connecting said fluid receiving chamber to said cleaning fluid discharge means to provide cleaning fluid from said fluid receiving chamber to said cleaning fluid discharge means;

a vacuum generating means mounted in said vacuum blower chamber and operative to create a vacuum in said plenum chamber and fluid receiving chamber;

a vacuum conduit means connecting said vacuum intake means to said fluid receiving chamber, said vacuum conduit means including a conduit inner end section and an elongated conduit extending from said nozzle head to said conduit inner end section, said conduit inner end section curving inwardly of said plenum chamber and downwardly at an angle into said fluid receiving chamber to direct fluid and air in said vacuum conduit means downwardly into said fluid receiving chamber; and a return air conduit means spaced above the conduit inner end section and connecting said plenum chamber to said vacuum blower chamber and having a first end opening into said vacuum blower chamber and a second end opening into said plenum chamber, said return air conduct means including a first conduit section extending from said first end downwardly into said plenum chamber toward said fluid receiving chamber and a second conduit section extending laterally frown said first conduit section to said second end to form an enclosed passageway from said first end to said second end.

2. The recycling extraction cleaner of claim 1 wherein said fluid receiving chamber includes sidewalls and said plenum chamber includes a front wall, said second conduit section of said return air conduit means extending laterally from said first conduit section toward the front wall of said plenum chamber.

3. The recycling extraction cleaner of claim 1 wherein said inner end section of said vacuum conduit means curves downwardly at an angle toward a side wall of said fluid receiving chamber to direct fluid and air in said vacuum conduit means against the sidewall of said fluid receiving chamber.

4. The recycling cleaner of claim 1 wherein said vacuum blower operates through said return air conduit means to create a vacuum in said plenum chamber, said vacuum blower means operating to create an exhaust air flow in said vacuum blower chamber, said nozzle head including a drying air discharge means, and said recycling cleaner further including drying air conduit means connecting said vacuum blower chamber to said drying air discharge means to conduct exhaust air flow from said vacuum generator means to said drying air discharge means.

5. The recycling extraction cleaner and drier of claim 4 which includes at least one vent formed on said vacuum blower chamber for exhausting said exhaust air flow to atmosphere, and air flow control means mounted on said body member, said air flow control means operating to selectively close said vent to preclude exhausting said exhaust air flow to atmosphere or to open said vent to exhaust said exhaust air flow.

6. The recycling extraction cleaner of claim 4 wherein said drying air discharge means includes an air discharge conduit extending along at least one side of said nozzle head to discharge said exhaust air flow, said cleaning fluid discharge head and vacuum intake means being positioned on said nozzle head inwardly of said air discharge conduit.

7. The recycling extraction cleaner of claim 4 wherein said drying air discharge means directs a stream of exhaust air against the surface to be cleaned, and said vacuum intake means is spaced from said fluid discharge means and said drying air discharge means and operates to remove fluid from said surface to be cleaned with dirt entrained in said fluid, said fluid being drawn by the vacuum in said plenum chamber through said vacuum intake means and vacuum conduit means.

8. The recycling extraction cleaner of claim 7 wherein said drying air conduit means is formed as part of said body member to extend between said vacuum blower chamber and said drying air discharge means.

9. The recycling extraction cleaner of claim 8 wherein said means for connecting said fluid receiving chamber to said cleaning fluid discharge head includes a fluid delivery pump means mounted in said plenum chamber, a first fluid conduit means connected to said fluid delivery pump means and extending therefrom into said fluid receiving chamber, said first fluid conduit means including an inlet end in said fluid receiving chamber, filter means connected to the inlet end of said first fluid conduit means, and second fluid conduit means extending from said fluid delivery pump means to said cleaning fluid discharge head.

10. An extraction cleaner for cleaning a surface comprising:

a body member for housing internal cleaner components including a vacuum blower chamber and a plenum chamber formed adjacent to said vacuum blower chamber;

a fluid receiving chamber mounted on said body member, said fluid receiving chamber being mounted in communication with said plenum chamber;

a nozzle head mounted on said body member and including a cleaning fluid discharge means for discharging cleaning fluid and a vacuum intake means for removing fluid and foreign material from the surface to be cleaned;

a vacuum generating means mounted in said vacuum blower chamber and operative to create a low pressure condition in said plenum chamber and fluid receiving chamber;

a vacuum conduit means connecting said vacuum intake means to said fluid receiving chamber and forming a continuous, enclosed passageway frown said vacuum intake means to a point within said fluid receiving chamber, said vacuum conduit means including a conduit inner end section having an open end in said fluid receiving chamber and an elongated conduit extending from the vacuum intake means of said nozzle head to said conduit inner end section, said conduit inner end section curving inwardly of said plenum chamber and downwardly at an angle into said fluid receiving chamber to direct fluid and air in said vacuum conduit means downwardly into said fluid receiving chamber; and a return air conduit means spaced above the conduit inner end section and connecting said plenum chamber to said vacuum blower chamber and having a first end opening into said vacuum blower chamber and a second end opening into said plenum chamber, said return air conduct means including a first conduit section extending from said first end downwardly into said plenum chamber toward said fluid receiving chamber and a second conduit section extending laterally from said first conduit section to said second end to form an enclosed passage between said first and second ends.

11. The extraction cleaner of claim 10 which includes a fluid inlet conduit extending externally from said body member to a source of fluid under pressure, fluid control means mounted on said body member and connected to said fluid inlet conduit and to said cleaning fluid discharge means, said fluid control means operating to provide fluid from said fluid inlet conduit to said cleaning fluid discharge means;

a fluid outlet conduit extending externally from said body member;

pump means mounted on said body member and connected to said fluid outlet conduit, and to said fluid receiving chamber, said pump means operating to pump fluid from said fluid receiving chamber to said fluid outlet conduit.

12. The extraction cleaner of claim 11 wherein said fluid receiving chamber includes sidewalls and said plenum chamber includes a front wall, said second conduit section of said return air conduit means extending laterally from said first conduit section toward the front wall of said plenum chamber.

13. The extraction cleaner of claim 12 wherein said inner end section of said vacuum conduit means curves downwardly at an angle toward a sidewall of said fluid receiving chamber to direct fluid and air in said vacuum conduit means against the sidewall of said fluid receiving chamber.

14. The cleaner of claim 12 wherein said vacuum blower operates through said return air conduit means to create a lowered pressure in said plenum chamber, said vacuum blower means operating to create an exhaust air flow in said vacuum blower chamber, said nozzle head including a drying air discharge means, and said body member further including drying air conduit means to provide exhaust air flow from said vacuum blower chamber to said drying air discharge means.

15. The extraction cleaner of claim 13 wherein said fluid receiving chamber is removably mounted on said body member.

16. The extraction cleaner of claim 13 wherein said fluid control means includes valve means to control fluid flow to said cleaning fluid discharge means.

17. The extraction cleaner of claim 16 wherein said fluid control means operates to initiate operation of said pump means when fluid is provided thereby to said cleaning fluid discharge means.

18. The extraction cleaner of claim 10 which includes means for connecting said fluid receiving chamber to said cleaning fluid discharge head including a fluid delivery pump means mounted in said plenum chamber, a first fluid conduit means connected to said fluid delivery pump means and extending therefrom into said fluid receiving chamber, said first fluid conduit means including an inlet end in said fluid receiving chamber and second fluid conduit means extending from said fluid delivery pump means to said cleaning fluid discharge head.

19. The extraction cleaner of claim 18 which includes power control means mounted on said body member to control the energization of said vacuum generating means and said pump means, said power control means causing said pump means to be energized only when said vacuum generating means is energized.

20. An extraction cleaner for cleaning a surface comprising:

a body member for housing internal cleaner components, a handle mounted at a first end of said body member, a nozzle head mounted at a second end of said body member opposite to and spaced from said first end, said nozzle head including a cleaning fluid discharge means and a vacuum intake means, a vacuum blower chamber formed in said body member adjacent to said handle, and a plenum chamber formed in said body member adjacent to said vacuum blower chamber, said body member including a fluid chamber for containing cleaning fluid;

a vacuum generating means mounted in, said vacuum blower chamber and operative to create a reduced pressure in said plenum chamber and fluid receiving chamber, said vacuum generating means operating to create an exhaust air flow in said vacuum blower chamber, said nozzle head extending from said body member at an angle relative to the central longitudinal axis of said body member and including a forward wall and a rear wall, and drying air conduit means connected to said blower chamber to conduct the exhaust airflow therefrom, said drying air conduit means operating to direct said exhaust air flow against the rear wall of said nozzle head.

21. The extraction cleaner of claim 20 wherein said front wall of said nozzle head is transparent.

22. The extraction cleaner of claim 2 wherein said nozzle head extends from said body member at an angle relative to the central longitudinal axis of said body member in a direction away from the front wall of said plenum chamber and said handle extends from said body member at an angle relative to the central longitudinal axis of said body member in a direction away from the front wall of said plenum chamber.

23. The extraction cleaner of claim 1 wherein said nozzle head includes a front wall and a rear wall spaced from said front wall, said cleaning fluid discharge means and said vacuum intake means being separately formed between the front and rear walls of said nozzle head, and a contact plate for contacting the surface to be cleaned extending between the front and rear walls of said nozzle head, said contact plate having fluid openings in communication with said fluid discharge means and vacuum openings in communication with said vacuum intake means.

24. The extraction cleaner of claim 23 wherein one of said nozzle head front or rear walls forms a wall for said cleaning fluid discharge means, said wall for said cleaning fluid discharge means being transparent.

25. The extraction cleaner of claim 23 wherein said nozzle head includes flexible squeegee means extending outwardly from said contact plate outwardly of said fluid and vacuum openings.

26. An extraction cleaner for cleaning a surface with a continuous flow of water under pressure from an external faucet and providing dirty discharge water to a discharge receiver comprising:

a body member for housing internal cleaner components, a handle mounted at a first end of said body member, a nozzle head mounted at a second end of said body member opposite to and spaced from said first end, said nozzle head including a cleaning fluid discharge means and a vacuum intake means, a vacuum blower chamber formed in said body member adjacent to said handle, and a plenum chamber formed in said body member adjacent to said vacuum blower chamber, said body member including a fluid receiving chamber for containing cleaning fluid;

a vacuum generating means mounted in said vacuum blower chamber and operative to create a reduced pressure in said plenum chamber and fluid receiving chamber;

a vacuum conduit means connecting said vacuum intake means to said fluid receiving chamber;

an input fluid conduit means within said body member for providing clean water to said cleaning fluid discharge means;

a flexible fluid conduit connected to said input fluid conduit means and extending from said body member for connection to said external faucet;

a fluid delivery pump means mounted within said body member and operative when activated to pump fluid from said fluid receiving chamber;

a pump input conduit connected to said fluid delivery pump means and extending therefrom into said fluid receiving chamber and fluid discharge conduit means connected to receive fluid from said fluid delivery pump means, said fluid discharge conduit means extending externally of said body member to a discharge receiver, said conduit means including fluid control means mounted on said body member and connected to said fluid inlet conduit, said fluid control means including valve means which is opened or closed to control fluid flow from said fluid inlet conduit to said cleaning fluid discharge means and actuator means to open said valve means, said actuator means operating to activate said fluid delivery pump means when said valve means is opened.

* * * * *